US007201599B2

(12) United States Patent
Holub

(10) Patent No.: US 7,201,599 B2
(45) Date of Patent: Apr. 10, 2007

(54) ELECTRICAL CONNECTOR LATCH

(75) Inventor: Franklin Anthony Holub, West Bloomfield, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/806,731

(22) Filed: Mar. 23, 2004

(65) Prior Publication Data

US 2005/0215106 A1 Sep. 29, 2005

(51) Int. Cl.
*H01R 13/627* (2006.01)

(52) U.S. Cl. ..... 439/357; 439/352; 439/595

(58) Field of Classification Search ..... 439/350–358, 439/310, 488–489, 372, 595, 701, 752
See application file for complete search history.

(56) References Cited

U.S. PATENT DOCUMENTS 4,708,413 A * 11/1987 Schroeder ..... 439/358
5,145,356 A * 9/1992 Minnis ..... 439/352
5,595,492 A 1/1997 Taguchi ..... 439/157
5,605,472 A 2/1997 Sakai et al. ..... 439/489
5,628,648 A * 5/1997 Higgins et al. ..... 439/489
5,643,003 A 7/1997 Myer et al. ..... 439/352
5,681,178 A 10/1997 Kunkle et al. ..... 439/352
5,928,038 A 7/1999 Berg et al. ..... 439/752
5,947,763 A 9/1999 Alaksin ..... 439/489
6,004,153 A 12/1999 Myer et al. ..... 439/352
6,383,009 B2 5/2002 Kawase et al. ..... 439/352
6,406,319 B2 * 6/2002 Pederson et al. ..... 439/352
6,419,515 B1 * 7/2002 Okayasu ..... 439/358
6,514,098 B2 * 2/2003 Marpoe et al. ..... 439/352

* cited by examiner

*Primary Examiner*—Truc T. Nguyen
*Assistant Examiner*—Edwin A. Leon
(74) *Attorney, Agent, or Firm*—Harrington & Smith, PC

(57) ABSTRACT

An electrical connector including electrical contacts, a first housing member and a second housing member. The first housing member has contact receiving areas. The electrical contacts are located in the contact receiving areas. The second housing member is connected to the first housing member and comprises a mating electrical connector latch comprising a latch surface at a front end of the latch and a lever arm extending reward from the front end of the latch. The lever arm is adapted to pivot on top of a portion of the second housing member.

24 Claims, 4 Drawing Sheets

ELECTRICAL CONNECTOR LATCH

BACKGROUND OF THE INVENTION

1. Field of the Invention

The present invention relates to electrical connectors and, more particularly, to a latch on an electrical connector for latching with a mating second electrical connector.

2. Brief Description of Prior Developments

Latches for retaining electrical connectors together after they are mated are generally well known in the art. U.S. Pat. No. 5,947,763 discloses a pivoting latch with torsion arms which can be locked in a latched position with a connector position assurance (CPA) member.

There is a desire to provide a latch on an electrical connector which requires a higher ramp force for a greater audible click and greater latching strength. There is also a desire to provide a latch pivoting system which provides greater mechanical flexibility and a simplified tooling for manufacturing of the connector parts. There is also a desire for a system for preventing overstress of a lever latch in an electrical connector and which allows for superior gripping of the housing by a user for connector separation.

SUMMARY OF THE INVENTION

In accordance with one aspect of the present invention, an electrical connector is provided including electrical contacts, a first housing member and a second housing member. The first housing member has contact receiving areas. The electrical contacts are located in the contact receiving areas. The second housing member is connected to the first housing member and comprises a mating electrical connector latch comprising a latch surface at a front end of the latch and a lever arm extending reward from the front end of the latch. The lever arm is adapted to pivot on top of a portion of the second housing member.

In accordance with another aspect of the present invention, an electrical connector housing is provided comprising a first housing member and a second housing member. The first housing member comprises a movable mating electrical connector latch. The latch has a first end with a latching surface and an opposite second end. The second housing member is connected to the first housing member and comprises a latch overstress protection section comprising a portion of the second housing member being adapted to be contacted by the second end of the latch to limit movement of the second end of the latch in an outward direction.

In accordance with another aspect of the present invention, an electrical connector housing is provided comprising a main housing and a seal retainer. The main housing has a movable mating electrical connector latch. The latch comprises a front end with a latching surface and an opposite rear end with a finger contact section. The seal retainer is adapted to be connected to the main housing to retain a seal inside the main housing. The seal retainer comprises a fulcrum section for the latch to pivot on and a grip rib behind the rear end of the latch which has a top surface that is located vertically above the rear end of the latch only when the rear end of the latch is depressed inward.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
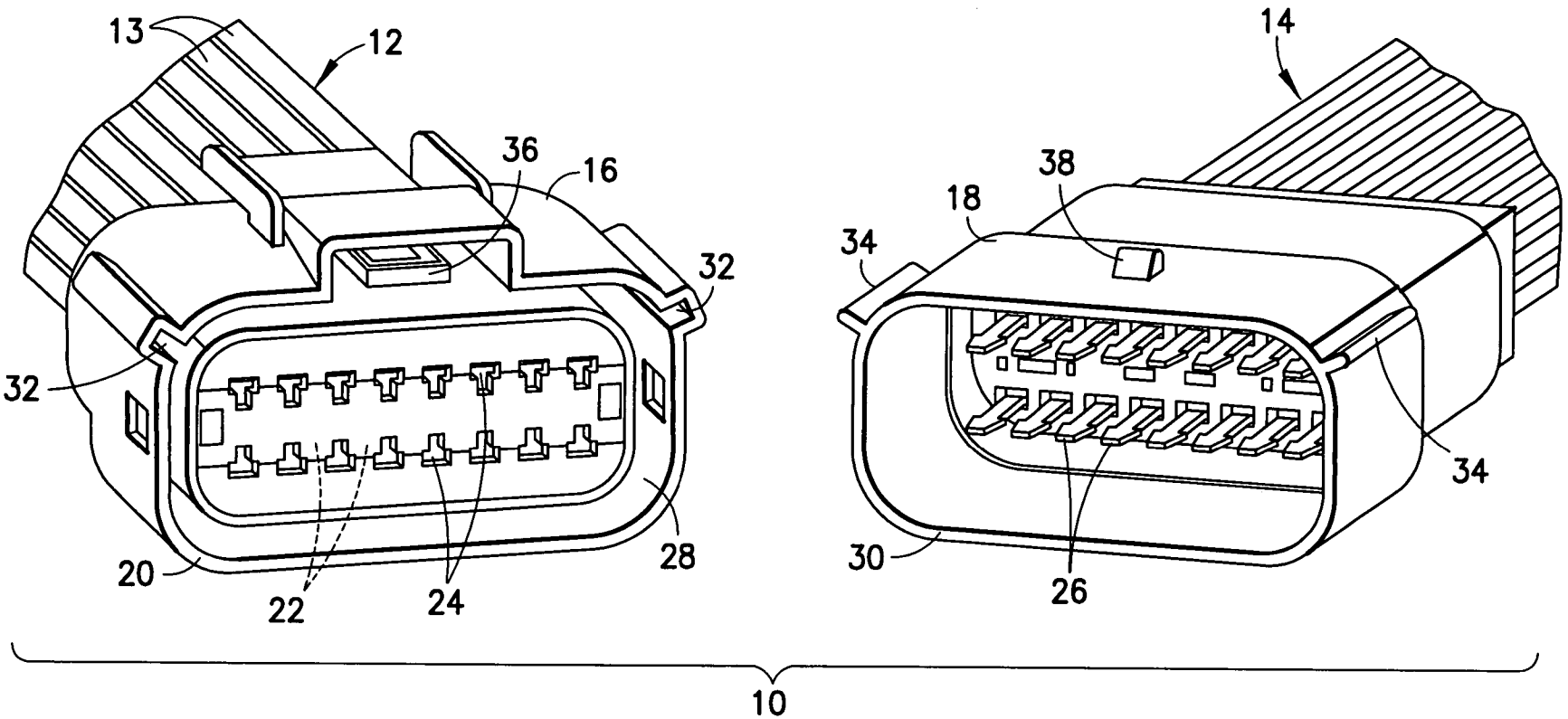
FIG. 1 PRIOR ART
FIG. 1 is an exploded perspective view of a conventional electrical connection system.

Referring to FIG. 1, there is shown an exploded perspective view of a conventional electrical connection system 10 for electrically connecting two groups 12, 14 of electrical conductors to each other. The electrical connection system 10 comprises a first electrical connector 16 connected to the first group 12 of electrical conductors 13 and a second electrical connector 18 connected to the second group 14 of electrical conductors. The first electrical connector 16 comprises a housing 20 and electrical contacts 22 located inside the housing 20. The housing 20 has receiving areas 24 in its front face for receiving male contacts 26 of the second electrical connector 18. The housing 20 also comprises the receiving area 28 for receiving the front end of the housing 30 of the second electrical connector 18. The receiving areas 28 comprises slots 32 for receiving polarizing ribs 34 of the second electrical connector 18. The housing 20 also comprises a latch 36 which extends into the receiving area 28. The latch 36 is adapted to snap lock latch with the latch protrusion 38 of the housing 30 of the second electrical connector 18.

Figure 2:
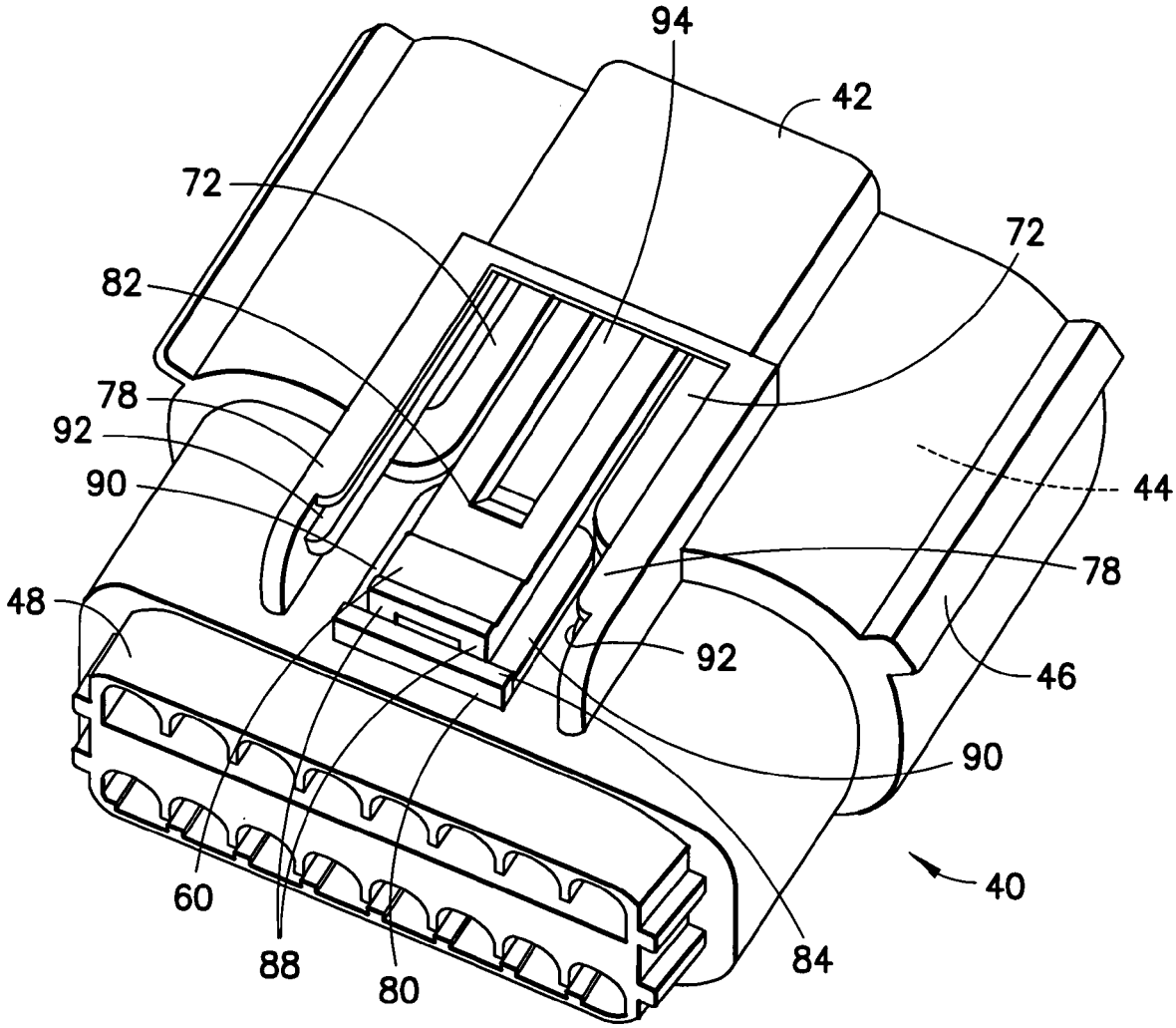
FIG. 2 is a perspective view of an electrical connector incorporating features of the present invention.
Figure 3:
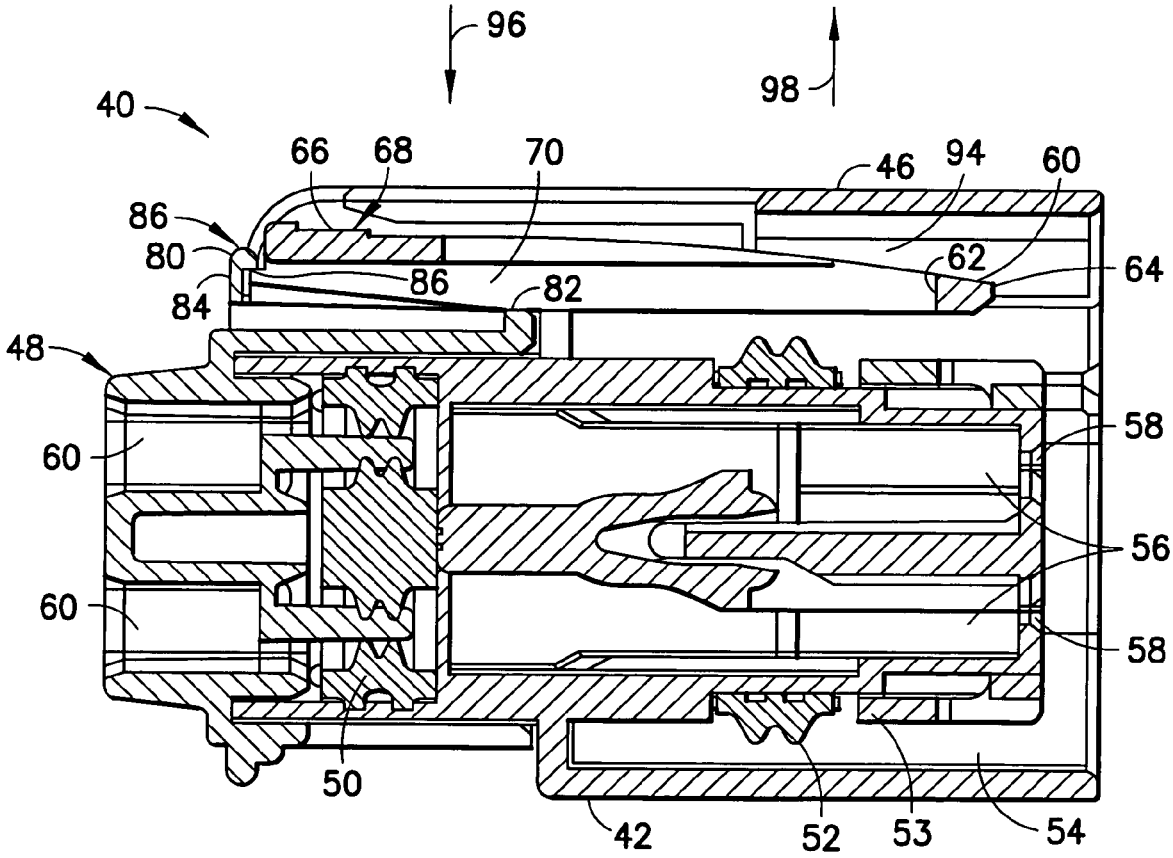
FIG. 3 is a cross sectional view of the electrical connector shown in FIG. 2.

Referring now also to FIGS. 2 and 3, an electrical connector 40 incorporating features of the present invention is shown. Although the present invention will be described with reference to the exemplary embodiment shown in the drawings, it should be understood that the present invention can be embodied in many alternate forms of embodiments. In addition, any suitable size, shape or type of elements or materials could be used.

The electrical connector 40 is intended to replace or be used instead of the first electrical connector 16. In particular, the electrical connector 40 is adapted to be connected to the first group 12 of electrical conductors and be removably connected to the second electrical connector 18. The electrical connector 40 comprises a housing 42 and a electrical contacts 44. The electrical contacts 44 are not shown in FIG. 3 merely for the sake of clarity. The electrical contacts 44 comprise contacts which are coupled to the electrical conductors 13 in the first group 12 of electrical conductors. The electrical contacts 44 comprise female contact sections adapted to receive the male contacts 26 of the second electrical connector 18. Any suitable type of electrical contacts could be provided inside the housing 42.

The housing 42 comprises a main housing member 46 and a seal retainer 48. The seal retainer 48 is fixedly connected to the rear end of the main housing member 46, such as by a snap lock connection, to capture a seal 50 between the seal retainer 48 at the main housing member 46. The seal 50 provides a seal with the electrical conductors 13. The electrical connector 40 also comprises a second seal 52 adapted to engage the housing 30 of the second electrical conductor 18 in the receiving area 54 of the main housing member 46. A front seal retainer 53 is attached to the front of the main housing member 46 to retain the front seal 52 on the main housing member 46.

The main housing member 46 comprises contact receiving areas 56. The electrical contacts 44 are located in the contact receiving areas 56. The front end of the main housing member 46 comprises apertures 58 into the contact receiving areas 56. The apertures 58 are adapted to allow insertion of the male contacts 26 into the contact receiving areas 56 and into mating electrical connection with the electrical contacts 44. The electrical conductors 13 are adapted to extend through apertures 60 of the seal retainer 48 and into the contact receiving areas 56 where they are connected to the electrical contacts 44. The seal 50 is adapted to seal the rear end of the contact receiving areas 56 at the rear end of the main housing member 46 where the electrical conductors 13 pass into the rear end of the main housing member 46.

Figure 4:
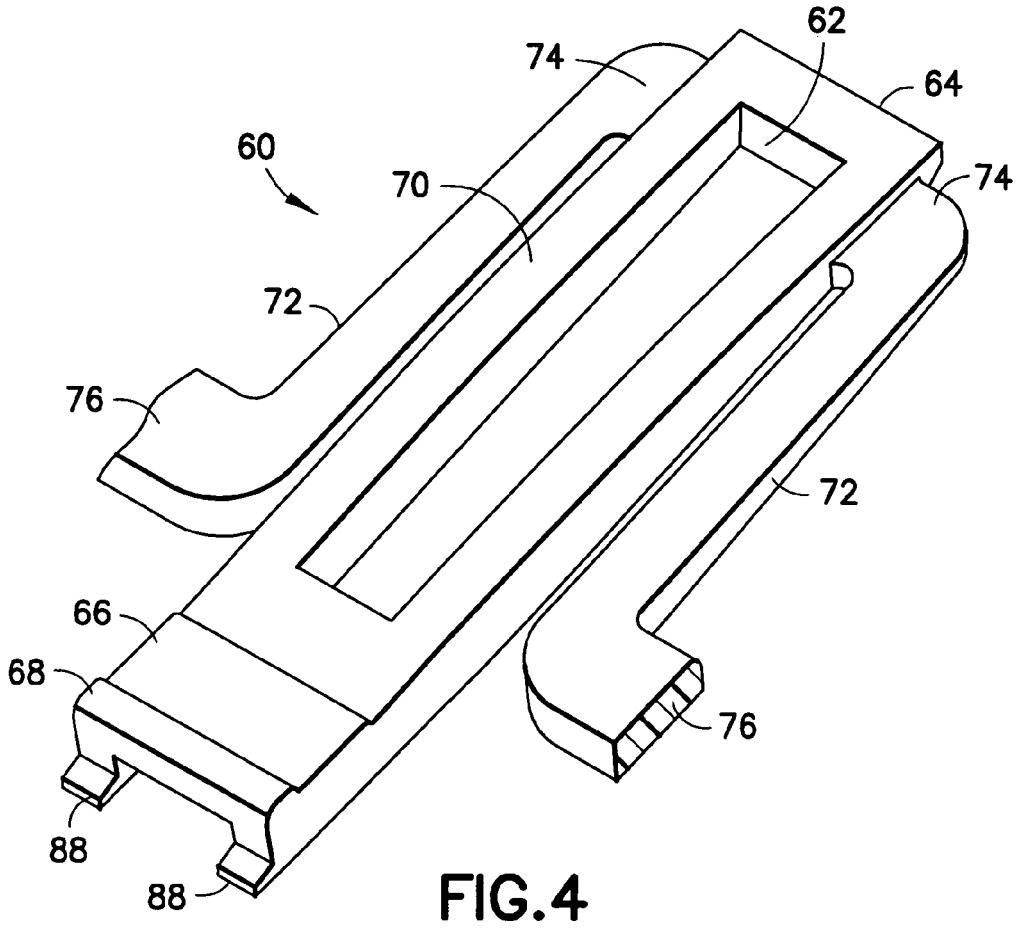
FIG. 4 is a perspective view of the latch used in the electrical connector shown in FIGS. 2 and 3.
Figure 5:
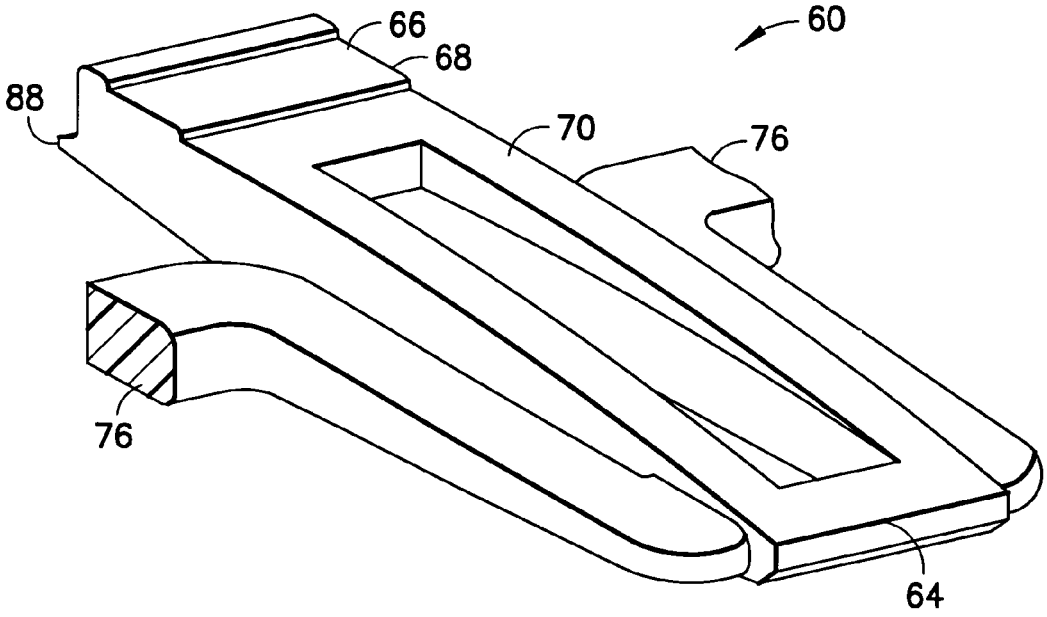
FIG. 5 is a perspective view of the latch shown in FIG. 4 taken from a front side.

The main housing member 46 comprises a mating electrical connector latch 60. When the electrical connector 40 is connected to the second electrical connector 18, the latch 60 is adapted to removably latch with the latch protrusion 38 of the second electrical connector 18. Referring also to FIGS. 4 and 5, the latch 60 generally comprises a lever arm 70 having a latch surface 62 at a front end 64 and a user finger contact surface 66 at a rear end 68, and two deflectable arms 72.

The main housing member 46 is preferably a one-piece member comprised of molded plastic or polymer material. Thus, the latch 60 is preferably integrally formed with the rest of the main housing member 46. The front end 64 of the lever arm 70 extends into the receiving area 54. The rear end 68 of the lever arm 70 extends out of the main housing member 46 at the top rear side of the main housing member. The deflectable arms 72 are located on opposite lateral sides of the lever arm 70.

The deflectable arms 72 comprises first ends 74 which are attached to the front 64 of the lever arm 70. The deflectable arms 72 comprises second ends 76 which are attached to top rails 78 of the main housing member 46. The deflectable arms 72 extend inward towards each other and forward towards the front end 64 of the lever arm 70. The deflectable arms 72 form combined torsion bars and spring leafs to allow pivoting movement of the lever arm 70 relative to the rest of the main housing member 46. The second ends 76 are located proximate the middle or center section of the lever arm 70 close to the rear end 68. With the present invention, the deflectable arms 72 provide forward facing latch beams, integral with the main housing member, to provide a higher ramp force with the latch protrusion 38 of the mating electrical connector 18 for greater audible click and greater latching strength. Before connection of the seal retainer 48 to the main housing member 46, the lever arm 70 is substantially free-floating; supported merely by connection of the deflectable arms 72 at the front end 64.

As seen best in FIGS. 2 and 3, the seal retainer 48 comprises a raised portion 80 on the top side of the seal retainer. The raised portion 80 comprises a front rail 82 and a rear rail 84. The front rail 82 is located beneath the lever arm 70. More specifically, when the seal retainer 48 is connected to the main housing member 46, the bottom surface of the lever arm 70 rests against the top surface of the front rail 82. The front rail 82 forms a fulcrum rib for the lever arm 70 as further understood from the description below. The front rail 82 is provided on the seal retainer 48 rather than on the main housing member 46. This provides a pivot feature, provided by the seal retainer, which allows for greater mechanical flexibility and a simplified tooling. The rear rail 84 comprises a forward projecting ledge 86 at its top side. The real rail 84 forms a grip rib as well as a portion of a latch overstress protection system as further described below.

As seen in FIG. 2, the raised portion 80 also comprises two sidewalls 90 located between the front rail 82 and the rear rail 84. The sidewalls 90 are spaced from each other to allow free movement of the rear end 68 of the lever arm 70 therebetween. The sidewalls 90 provide anti-snag walls, provided by the seal retainer 48 rather than the main housing member 46, to allow the latch button feature of the rear end 68 to be closely protected without the need of complicated tooling; which would otherwise be needed for manufacturing an equivalent feature on the main housing 46. Manufacturer of the seal retainer 46 with the anti-snag sidewalls 90 does not require complicated tooling.

The rear end 68 of the lever arm 70 comprises two projections 88. The projections 88 are located beneath the ledge 86 of the rear rail 84. The projections 88 are adapted to contact the bottom side of the ledge 86 to prevent overstress of the latch 60 which could result in permanent deformation, such as if the rear end 68 was moved to far outward. This provides a snag overstress feature, provided by engagement of the seal retainer and the main housing member, to provide an easy to tool, ergonomically friendly, latch overstress protection.

When the second electrical connector 18 is attached to the electrical connector 40, the front of the housing 30 will extend into the receiving area 54 of the housing 42. The latch protrusion 38 will contact the front end 64 of the latch and deflect the front end 64 outward until the latch protrusion 38 passes by the front end. During this process, the deflectable arms 72 will bend to allow the front end 64 to deflect outward and the lever arm 70 will pivot on top the front rail 82. After the latch protrusion 38 passes by the front end 64, the front end 64 will snap back, because of the forces exerted by the deflected arms 72, to locate the latch surface 62 behind the latch protrusion 38.

As seen best in FIG. 3, the top of the user contact surface 66 at the rear end 68 of the lever arm 70 is normally located above the top surface of the rear rail 84. In order to disconnect the electrical connector 40 from the second electrical connector 18, the user must first disconnect the latch 60 from the latch protrusion 38. In order to accomplish this, the user depresses the user contact section 66 inward as indicated by arrow 96. The lever arm 70 can pivot on the front rail 82 to move the front end 64 outward away from the rear end of the latch protrusion 38 as indicated by arrow 98. As the user contact surface 66 is moved inward, the top of the user contact surface 66 can be moved below the top surface of the rear rail 84. The top surface of the rear rail 84 forms a grip rib behind the rear end of the latch which has a top surface that is located vertically above the rear end of the latch only when the rear end 68 of the latch is depressed inward. This grip rib formed by the top surface of the rear rail 84 provides an enhanced contact surface for the user and makes withdrawal of the electrical connector 40 from the second electrical connector 18 easier to accomplish. The grip rib, provided by the seal retainer 48 rather than the main housing member 46, allows superior grip for connector separation.

In the embodiment shown in FIG. 2, the top rails 78 of the main housing member 46 forms side slots 92 which are adapted to receive outer sides of a connector position assurance (CPA) member (not shown). The main housing member 46, thus, provides a channel for a CPA member above the latch 60. The CPA member can be slid into the main housing member 46 above the latch 60 and into a location 94 above the lever arm 70 to prevent the latch 60 from becoming accidentally disengaged from the latch protrusion 38. However, in an alternate embodiment, a CPA member might not be provided. The rear end 68 of the lever arm 70 can be located in a reward path of the CPA member to prevent inadvertent removal of the CPA member from the electrical connector 40. The rear end 68 would need to be depressed during rearward movement of the CPA member to allow the CPA member to be removed from the main housing member 46.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical connector adapted to connect to a mating electrical connector comprising:

electrical contacts; and a first housing member having contact receiving areas, wherein the electrical contacts are located in the contact receiving areas, and a mating electrical connector latch comprising a latch surface at a front end of the latch and a lever arm extending rearward from the front end of the latch; and a second housing member connected to the first housing member and having a fulcrum rib, and wherein the lever arm is sized and shaped to pivot about and against the fulcrum rib of the second housing member.

2. An electrical connector as in claim 1 further comprising an electrical conductor seal, wherein the second housing member comprises a seal retainer which is connected to the first housing member to retain the seal with the first housing member.

3. An electrical connector as in claim 1 wherein the first housing member comprises a first deflectable arm connecting the latch to the first housing member, wherein the first deflectable arm is connected to the latch at the front end of the latch.

4. An electrical connector as in claim 3 wherein the first housing member comprises a second deflectable arm connecting the latch to the first housing member, wherein the a second deflectable arm is connected to the latch at the front end of the latch.

5. An electrical connector as in claim 4 wherein the first and second deflectable arms are connected to the first housing member proximate a center section of the latch.

6. An electrical connector comprising:

electrical contacts; and a first housing member having contact receiving areas, wherein the electrical contacts are located in the contact receiving areas, and a mating electrical connector latch comprising a latch surface at a front end of the latch and a lever arm extending rearward from the front end of the latch; and a second housing member connected to the first housing member and having a fulcrum rib, and wherein the lever arm is adapted to pivot against the fulcrum rib of the second housing member, wherein a rear end of the latch comprises a finger contact section, and wherein the fulcrum rib contacts a bottom side of the lever between the front end and the rear end.

7. An electrical connector comprising:

electrical contacts; and a first housing member having contact receiving areas, wherein the electrical contacts are located in the contact receiving areas, and a mating electrical connector latch comprising a latch surface at a front end of the latch and a lever arm extending rearward from the front end of the latch; and a second housing member connected to the first housing member and having a fulcrum rib, and wherein the lever arm is adapted to pivot against the fulcrum rib of the second housing member, wherein a rear end of the latch comprises a projection located beneath a ledge of the second housing member.

8. An electrical connector as in claim 7 wherein the ledge of the second housing member and the projection on the rear end of the latch for a latch overstress protection system adapted to limit movement of the second end of the latch in an outward direction.

9. An electrical connector comprising:

electrical contacts; and a first housing member having contact receiving areas, wherein the electrical contacts are located in the contact receiving areas, wherein the first housing member comprises a mating electrical connector latch comprising a latch surface at a front end of the latch and a lever arm extending rearward from the front end of the latch; and a second housing member connected to the first housing member and having a fulcrum rib, and wherein the lever arm is adapted to pivot against the fulcrum rib of the second housing member, wherein the second housing member comprises a grip rib behind a rear end of the latch which has a top surface that is located vertically above the rear end of the latch only when the rear end of the latch is depressed inward.

10. An electrical connector housing adapted to connect to a housing of a mating electrical connector comprising:

a first housing member comprising a pivotable mating electrical connector latch, the latch having a first end with a latching surface and an opposite second end; and a second housing member connected to the first housing member and having a fulcrum rib, the pivotable mating electrical connector latch having a lever arm adapted to pivot against the fulcrum rib of the second housing, the second housing member comprising a latch overstress protection section comprising a portion of the second housing member being sized and shaped to be contacted by the second end of the latch to limit pivotal movement of the second end of the latch in an outward direction.

11. An electrical connector housing as in claim 10 wherein the latch is located on top of the fulcrum rib and is adapted to pivot on the fulcrum rib to move the latching surface inward and outward.

12. An electrical connector as in claim 10 wherein the second end of the latch comprises a finger contact section.

13. An electrical connector as in claim 10 wherein the second end of the latch comprises a projection located beneath the latch overstress protection section of the second housing member.

14. An electrical connector as in claim 10 further comprising an electrical conductor seal, wherein the second housing member comprises a seal retainer which is connected to the first housing member to retain the seal with the first housing member.

15. An electrical connector as in claim 10 wherein the second housing member comprises a grip rib behind the second end of the latch which has a top surface that is located vertically above the second end of the latch only when the second end of the latch is depressed inward.

16. An electrical connector housing as an claim 10 wherein the first housing member comprises a first deflectable arm connecting the latch to the first housing member, wherein the first deflectable arm is connected to the latch at the first end of the latch.

17. An electrical connector as in claim 16 wherein the first housing member comprises a second deflectable arm connecting the latch to the first housing member, wherein the second deflectable arm is connected to the latch at the first end of the latch.

18. An electrical connector as in claim 17 wherein the first and second deflectable arms are connected to the first housing member proximate a center section of the latch.

19. An electrical connector housing comprising:

a main housing having a movable mating electrical connector latch, the latch comprising a front end with a latching surface and an opposite rear end with a finger contact section; and a seal retainer adapted to be connected to the main housing to retain a seal inside the main housing and having a fulcrum rib, the movable mating electrical connector latch having a lever arm adapted to pivot against the fulcrum rib of the seal retainer, the seal retainer comprising a grip rib behind the rear end of the latch which has a top surface that is located vertically above the rear end of the latch only when the rear end of the latch is depressed inward.

20. An electrical connector housing as in claim 19 wherein the first housing member comprises two deflectable arms connecting the latch to the first housing member, wherein the deflectable arms are connected to the latch at the front end of the latch and connected to the first housing member proximate a middle section of the latch.

21. An electrical connector comprising:

electrical contacts;

a first housing member having contact receiving areas, wherein the electrical contacts are located in the contact receiving areas, and a mating electrical connector latch comprising a latch surface at a front end of the latch and a lever arm extending rearward from the front end of the latch;

a seal on the first housing member; and a seal retainer housing member connected to the first housing member and retaining the seal on the first housing member, the seal retainer housing member having a fulcrum rib and the lever arm is adapted to pivot against the fulcrum rib of the seal retainer housing member, and wherein the lever arm comprises a user contact surface at a rear end of the lever arm which is located directly above the seal retainer housing member.

22. An electrical connector as in claim 21 wherein the mating electrical connector latch comprises two deflectable arms fixedly attached to the first housing member at two spaced points.

23. An electrical connector as in claim 22 wherein the two deflectable arms comprise front ends connected to the front end of the latch and rear ends connected to the two spaced points.

24. An electrical connector comprising:

electrical contacts; and a first housing member having contact receiving areas, wherein the electrical contacts are located in the contact receiving areas, and a mating electrical connector latch comprising a latch surface at a front end of the latch and a lever arm extending rearward from the front end of the latch; and a second housing member connected to the first housing member, the second housing member having a fulcrum rib and the lever arm is adapted to pivot against the fulcrum rib of the second housing member, wherein the lever arm comprises a user contact surface at a rear end of the lever arm, wherein the mating electrical connector latch comprises two deflectable arms wherein the two deflectable arms comprise front ends connected to the front end of the latch and rear ends fixedly attached to the first housing member at two spaced points, wherein the rear ends connect the latch to the first housing member.

* * * * *

UNITED STATES PATENT AND TRADEMARK OFFICE

CERTIFICATE OF CORRECTION

PATENT NO. : 7,201,599 B2
APPLICATION NO. : 10/806731
DATED : April 10, 2007
INVENTOR(S) : Holub It is certified that error appears in the above-identified patent and that said Letters Patent is hereby corrected as shown below:

IN THE CLAIMS:

Claim 1: Column 5, line 27, after "latch" (second occurrence) and before "and" insert --adapted to connect the first housing and the mating electrical connector--

Claim 6: Column 5, line 57, after "latch" (second occurrence) and before "and" insert --adapted to connect the first housing and the mating electrical connector--

Claim 7: Column 6, line 6, after "latch" (second occurrence) and before "and" insert --adapted to connect the first housing and the mating electrical connector--

Claim 9: Column 6, line 26, after "latch" (second occurrence) and before "and" insert --adapted to connect the first housing and the mating electrical connector--

Claim 10: Column 5, line 41, after "surface" insert --adapted to connect the first housing and the mating electrical connector--

Claim 19: Column 7, line 22, after "surface" insert --adapted to connect the first housing and the mating electrical connector--

Claim 21: Column 8, line 1, after "latch" (second occurrence) and before "and" insert --adapted to connect the first housing and the mating electrical connector--

Claim 24: Column 8, line 27, after "latch" (second occurrence) and before "and" insert --adapted to connect the first housing and the mating electrical connector--

Signed and Sealed this

Third Day of July, 2007

JON W. DUDAS
*Director of the United States Patent and Trademark Office*